United States Patent [19]

Taniwaki

[11] 4,421,365

[45] Dec. 20, 1983

[54] MOVABLE STORAGE CABINET

[75] Inventor: Genshi Taniwaki, Kumamoto, Japan

[73] Assignee: Kongo Co., Ltd, Japan

[21] Appl. No.: 349,160

[22] Filed: Feb. 16, 1982

Related U.S. Application Data

[63] Continuation of Ser. No. 166,111, Jul. 3, 1980, abandoned, which is a continuation of Ser. No. 925,750, Jul. 18, 1978, abandoned.

[30] Foreign Application Priority Data

Oct. 3, 1977 [JP] Japan ..... 52-132898

[51] Int. Cl.[3] ..... A47B 53/02

[52] U.S. Cl. ..... 312/198; 104/287; 105/89; 105/131; 105/413; 280/638; 280/785; 295/36 R; 312/200

[58] Field of Search ..... 104/165, 287; 105/89, 105/101, 131, 413; 295/36 R; 414/331; 280/35, 638, 656, 785, 3; 312/198–201; 211/175; 301/126, 128; 180/241

[56] References Cited

U.S. PATENT DOCUMENTS

| | | | |
|---|---|---|---|
| 1,911,061 | 5/1933 | Clark | 280/785 |
| 3,020,059 | 2/1962 | Allen | 280/3 |
| 3,080,204 | 3/1963 | Lindhgren | 312/199 |
| 3,332,558 | 7/1967 | Wilson | 211/175 |
| 3,640,595 | 2/1972 | Staller et al. | 312/198 |
| 3,923,354 | 12/1975 | Young | 312/198 |
| 3,944,309 | 3/1976 | Taniwaki | 312/198 |
| 4,017,131 | 4/1977 | Camenisch | 312/198 |

FOREIGN PATENT DOCUMENTS

| | | | |
|---|---|---|---|
| 613471 | 7/1935 | Fed. Rep. of Germany | 295/36 |
| 7612065 | 5/1978 | Netherlands | 312/201 |
| 914980 | 1/1963 | United Kingdom | 312/201 |

*Primary Examiner*—Randolph Reese
*Attorney, Agent, or Firm*—McGlew and Tuttle

[57] ABSTRACT

A movable storage cabinet includes a plurality of saddles, in the form of inverted channels, and each provided with holes in its opposite lateral sides which receive the shafts of wheels. The saddles extend in the direction of depth of the cabinet, and the front and rear ends of adjacent saddles are connected together by a connection member, thus forming an underframe of the cabinet.

1 Claim, 6 Drawing Figures

MOVABLE STORAGE CABINET

This is a continuation application of Ser. No. 166,111 filed July 3, 1980 which is now abandoned, which itself was a continuation of Ser. No. 925,750 filed July 18, 1978, also now abandoned.

BACKGROUND OF THE INVENTION

As already known movable storage cabinet has wheels journaled on its bottom so as to run freely along rails installed on the floor. When such cabinets are used, they can be moved as desired, and an access to the interior of the cabinets can be achieved by providing an opening only in the front side of the cabinet, so that the cabinets can be juxtaposed in close succession to permit an efficient utilization of the limited space within a compartment.

In the prior art arrangement, the underframe, which includes a movable mechanism, and the storage chamber are designed in interrelated manner. In other words, the underframe is specifically designed for a particular storage chamber. Thus, if a variety of sizes, in particular, of the frontage, are required for storage cabinets, there must be designed a separate underframe for each of them. Additionally, an increased number of underframe parts is required for storage cabinets of a particular size, which results in a poor productivity and a burdensome maintenance of parts.

SUMMARY OF THE INVENTION

It is an object of the invention to provide a movable storage cabinet including an underframe, the parts of which are standardized to reduce the number of different parts so that a variety of storage cabinets having different frontage sizes can be assembled by a corresponding increase or decrease in the number of underframe parts, thus providing interchangeability of underframe parts to improve the productivity and to facilitate the maintenance of parts, thereby enabling movable storage cabinets to be provided inexpensively.

A feature of the invention resides in the fact that the movable storage cabinet includes an underframe which essentially comprises a plurality of saddles, in the form of inverted channels extending along the depth of the cabinet and each formed with aligned holes, in its opposite lateral sides, for receiving the shafts provided for bearing wheels and for supporting connection members which connect the front ends and the rear ends, respectively, of adjacent saddles together. As a result of such arrangement, the principal components of the underframe include only two members, namely, saddles of an identical configuration and connection members also of an identical configuration. Fasteners, such as conventional bolts and nuts, may be used to join the saddles and the connection members together. The number of saddles and connection members may be changed depending on the size of the frontage of various storage cabinets. Since the pricipal components, namely, the saddles and the connection members, are interchangeable, the productivity is improved and the maintanance of parts is facilitated, enabling a movable storage cabinet to be provided inexpensively.

Other objects, features and advantages of the invention will become apparent from the following description of an embodiment thereof with reference to the drawings.

BRIED DESCRIPTION OF THE DRAWINGS

DETAILED DESCRIPTION OF PREFERRED EMBODIMENT

Figure 1:
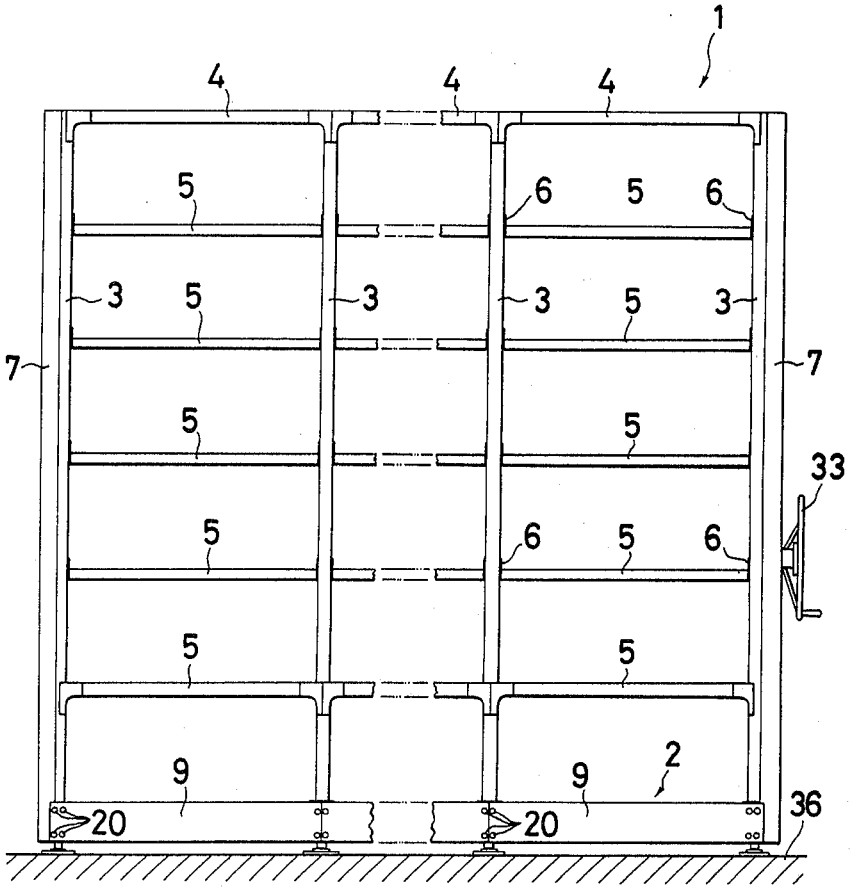
FIG. 1 is a front view of a movable storage cabinet constructed according to one embodiment of the invention.
Figure 2:
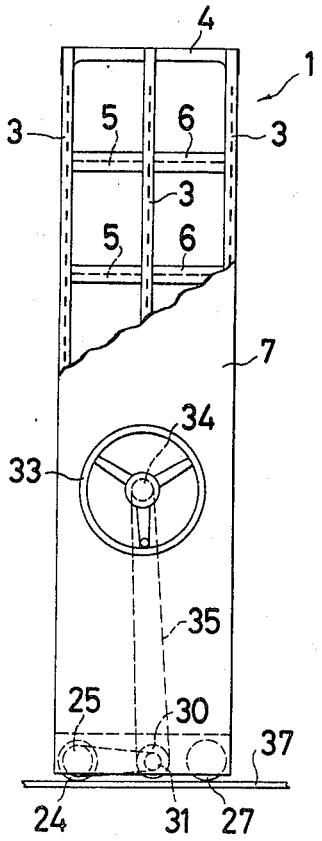
FIG. 2 is a right-hand side elevation, partly cut away.
Figure 6:
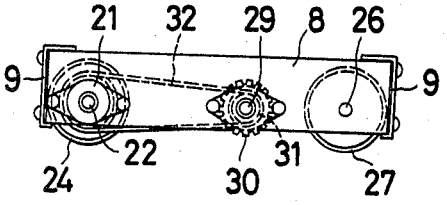
FIG. 6 is a right-hand side elevation of the underframe shown in FIG. 4.

Referring to FIGS. 1 and 2, a movable storage cabinet includes an underframe 2 on its bottom. A suitable number of stanchions 3 extend along the front and rear edges of the underframe 2 and along a transverse centerline which divides the depth of the cabinet. The stanchions are equally spaced crosswise or along the frontage of the cabinet. The upper ends of adjacent stanchions 3 are connected together by top plates 4, and the combination of the underframe 2, stanchions 3 and top plates 4 forms the overall frame of the cabinet 1. A suitable number of shelf plates 5 extend across adjacent posts or stanchions 3, and articles can be placed thereon. The shelf plates in the lowermost level are secured to the stanchions 3 to provide a reinforcement of the cabinet frame. Other shelf plates 5 rest on angular plates 6 which are engaged in and held by selected perforations formed in the sides of the stanchions 3, thereby permitting the vertical height of individual shelf plates 5 to be freely changed. A pair of side plates 7 are secured to the opposite sides of the cabinet 1 in spaced relationship from the three stanchions 3, which are located along each of the opposite sides, and from the opposite sides of the underframe so as to cover them. The cabinet 1 thus formed permits an access to articles from both the front and rear sides thereof.

Figure 3:
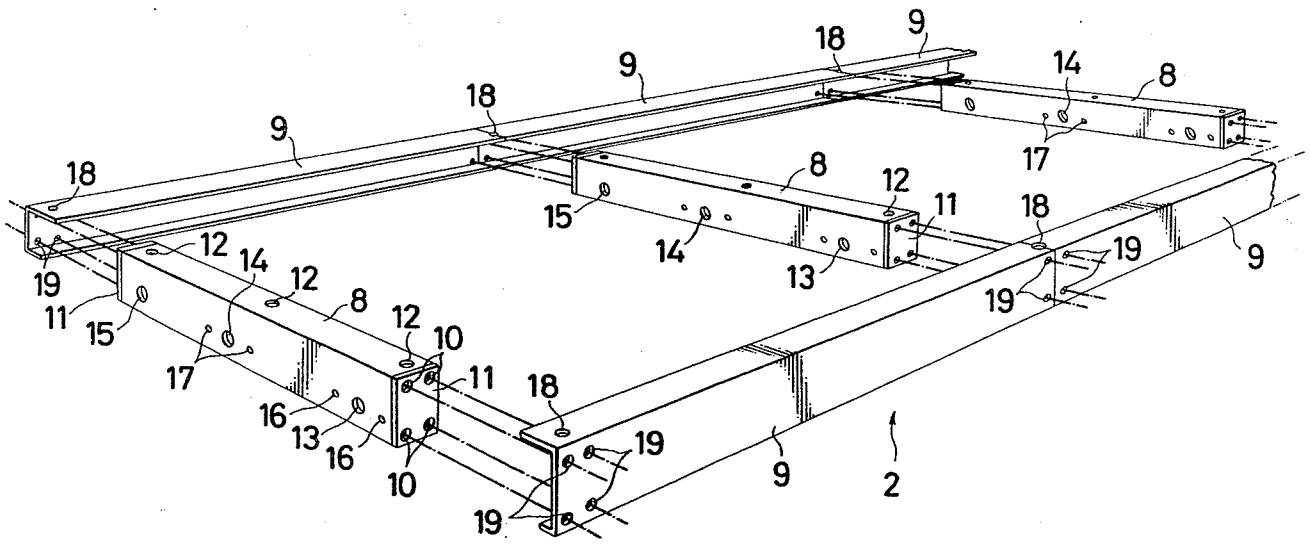
FIG. 3 is an exploded perspective view of the underframe shown in FIG. 1.

As shown in FIG. 3, the underframe 2 comprises a plurality of saddles 8 which extend in the direction of the depth of the cabinet, and connection members 9 which connect the front ends and the rear ends of adjacent saddles. Each saddle 8 is in the form of an inverted channel, and fixtures 11, having corner holes 10 are secured to the end faces of each saddle 8 as by welding. Adjacent its opposite ends and centrally along the length thereof, the top wall of the saddle 8 is formed with holes 12 which are adapted to receive the stanchions 3. The sides or flanges of each saddle 8 are formed with holes 13 which receive the shaft of a drive wheel, intermediate axle holes 14, and holes 15 which receive the shaft of a follower wheel, proceeding from right to left in FIG. 3. Pairs of bearing mounting holes 16, 17 are spaced on the opposite sides of the holes 13 and 14.

Each connection member 9 is channel-shaped, and, in principle, it has a length which is equal to the spacing between the transverse centerline of adjacent saddles 8. However, the connection members which are used at the opposite ends of the frontage of the cabinet have an increased length which is, by one-half the width of a saddle 8, greater in length than that of the remaining connection members so as to entirely cover the end faces of the saddles located at the opposite ends of the frontage. In this way, the outer flange of each end saddle is covered by the connection member 9. The connection members 9 are located in facing relationship toward each other so that they are open to receive the front and rear ends of the saddles 8. The members 9 are engaged with the saddles 8 so that their opposite limbs bear against the top and bottom surfaces of the saddles 8. At its outer ends, the upper limb of each connection member 9 which is located at one end of the frontage of the cabinet is formed with holes 18 which are to be aligned with holes 12 formed in the saddles 8 so as to receive the stanchions. The front wall or the bottom of the channel, of the connection member 9, is formed with holes 19 at its ends where it bears against the fixtures 11 so as to be aligned with holes 10 formed in the fixture. By passing bolts 20 (FIGS. 1 and 5) through the holes 19 and 10, and threadably engaging nuts, not shown, with the bolts, the saddles and the connection members are fastened together to form the frame which represents the underframe 2 of the storage cabinet. Each stanchion 3 has an end plate secured to its lower end in which a threaded bore is formed. By inserting a bolt through the holes 12, 18 from below and threadably engaging it with the bore, each stanchon is firmly secured in position on the underframe 2.

It will be seen that the number of saddles 8 is equal to the number of rows of the stanchions 3 as viewed across the frontage, and the saddles are equally spaced from each other by the same spacing as that between adjacent stanchions as viewed across the frontage. Consequently, a storage cabinet of a different size can be constructed using an increased or decreased number of rows of stanchions and using a corresponding number of saddles 8 and connection members 9. In this manner, the need for the provision of saddles and connection members of different sizes is avoided.

Referring to FIGS. 3 to 6, a pair of bearings 21 are threadedly secured to the opposite limbs or flanges of each saddle 8, utilizing the holes 16. Each bearing 21 is positioned so that the central bore of its inner race is in alignment with the holes 13 formed in the saddle 8, whereby these central bores can fittingly receive an axle or shaft 22 which has a sufficient length to extend through the pair of bearings 21 and which freely extends through the holes 13 formed in the saddle 8. The shafts 22 supported by the respective saddles 8 and by associated pairs of bearings 21 are coaxially connected together by means of connecting pipes 23. A running wheel 24 is coaxially and fixedly mounted on each shaft 22 inside the channel of each saddle 8, and the wheels 24, which are located at the opposite ends of a cabinet, are provided with a flange. A sprocket wheel 25 is coaxially and fixedly mounted on the shaft 22 which is located at the right-hand end of the cabinet, at a location nearer the center of the underframe 2.

Shaft 26 extend through holes 15 formed in each saddle 8 and have a sufficient length to extend through the full width thereof. It is to be understood that shafts 26 are rotatably supported by suitable bearing means. A running wheel 27 is coaxially and fixedly mounted on each shaft 26 inside the channel of each saddle 8. The wheels 27 located at the ends of the cabinet are provided with a flange.

Figure 4:
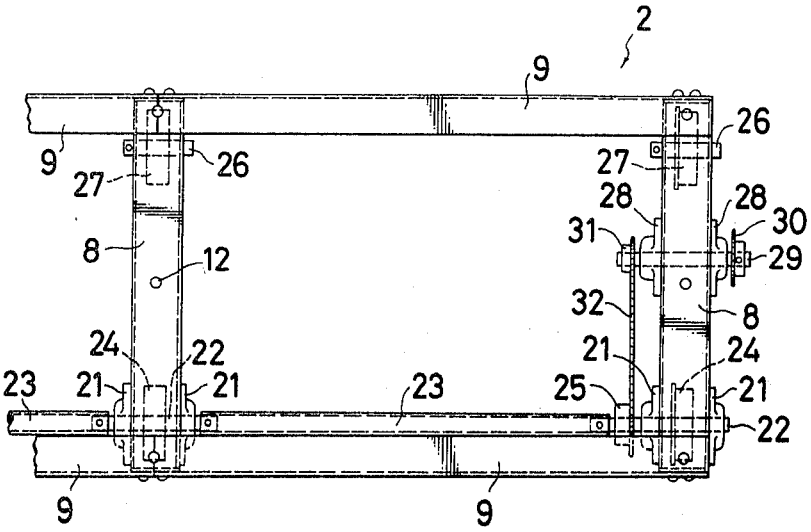
FIG. 4 is a plan view of the underframe with the drive mechanism assembled therein.
Figure 5:
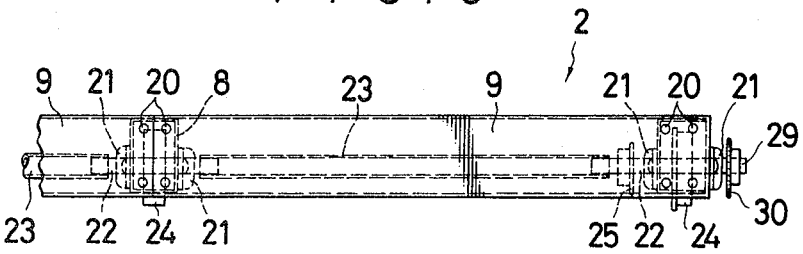
FIG. 5 is a front view of the underframe shown in FIG. 4.

Bearings 28 are threadably secured to the opposite limbs of the saddle 8 which is located at the right-hand of the cabinet, as viewed in FIGS. 4 and 5, utilizing the holes 17. The bearings 28 are positioned so that the central bores of their inner races are aligned with the holes 14 formed in the saddle 8, and these bores fittingly receive an intermediate shaft 29 of a sufficient length to extend through the pair of bearings and which freely extend through the holes 14 formed in the saddle 8, the shaft 29 forming part of a reduction gearing. Coaxially and fixedly mounted on the intermediate shaft 29 are a sprocket wheel 30 located outside the underframe 2 and another sprocket wheel 31 located inside the underframe 2. Sprocket wheels 31 and 25 are substantially of an equal diameter while the sprocket wheel 30 has a reduced diameter. An endless chain 32 extends around the sprocket wheels 31, 25.

As shown in FIGS. 1 and 2, a manually rotatable handle 33 is coaxially and fixedly mounted on a shaft which is rotatably disposed between the side plate 7 and the stanchion 3 located inwardly thereof, the handle 33 being located outside the side plate 7 of the cabinet 1. A sprocket wheel 34 of a reduced diameter is mounted on the handle shaft between the side plate 7 and the stanchion 3, and an endless chain 35 extends around the sprocket wheels 34, 30. Rails 37 are installed on a floor 36 of the compartment, and a cabinet is freely movable along the rails 37.

In operation, when the handle 33 is manually rotated, a reduction gearing comprising sprocket wheel 34, chain 35, sprocket wheel 30, intermediate shaft 29, sprocket wheel 31, chain 32 and sprocket wheel 25 transmits a rotating drive to the individual shafts 22 through the connecting pipes 23, whereby the individual wheels 24 can be rolled along the rails 37 to move the storage cabinet therealong in a facilitated manner, even if the cabinet has a substantial weight. As will be appreciated, the wheels 24 represent drive wheels while wheels 27 represent follower wheels. Since drive wheels 24 are integrally connected together through the connecting pipes 23, the drive from the handle 33 is evenly distributed among the individual drive wheels, avoiding a wobbling motion of the cabinet and assuring a smooth running thereof. A plurality of such movable storage cabinets can be placed on one set of rails 37, and can be selectively moved as desired. A passageway may be formed only between the rows of cabinets as mentioned previously.

It should be understood that, while the embodiment utilizes a manually rotatable handle to transmit a drive to the drive wheels through a reduction gearing, an electric motor may be used as drive means. Alternatively, if the cabinets are of a reduced size, they may be directly pushed forward by hand.

While a specific embodiment of the invention has been shown and described in detail to illustrate the application of the principles of the invention, it will be understood that the invention may be embodied otherwise without departing from such principles.

What is claimed is:

1. A movable storage cabinet supported on wheels for movement along rails installed on a floor and having a cabinet depth and an incremental cabinet length at least one incremental cabinet length making up an entire frontage length of the cabinet and the cabinet expandable in frontage length by said incremental cabinet length, said cabinet comprising:

a plurality of inverted U-shaped channels (8) forming saddles extending, in spaced relationship to each other, parallel to the depth of the cabinet, the flanges of said channels having aligned apertures (15, 13) for receiving wheel bearing shafts adjacent each end of said saddles with the number of said saddles equal to one more than the number of incremental cabinet lengths making up the entire frontage length of the cabinet;

wheel shafts (22, 26) engaged through said apertures;

wheels (24, 27) mounted on said shafts and in each of said channels to engage said rails and support said channels;

a fixture plate (11) connected to each end of said saddles with at least two openings (10) therein;

pairs of C-shaped connection members (9) with upper and lower flanges embraced around and secured to opposite ends of adjacent saddles and interconnecting adjacent pairs of said saddles having a length to extend across the space between adjacent saddles and substantially equal to said incremental cabinet length;

said connection members (9) each having at least one opening (19) aligned with one of said fixture plate openings (10) respectively, said connection members secured to said saddles by bolts extending through said aligned openings and a number of said pairs of connecting members chosen to form a desired entire frontage length of the cabinet, each saddle at each cabinet end in the frontage length direction having an outer channel flange thereof covered by an end of said connecting members at opposite ends of the cabinet;

each saddle other than said end saddle, connected to two pairs of connecting members each;

said saddles and an upper flange of each of said connection members formed with holes (12, 18) at the top thereof;

stanchions (3) extending through said top holes;

shelves (5) supported on said stanchions;

side plates (7) secured to the opposite ends of said cabinet;

a handle shaft rotatably mounted through one side plate of said cabinet;

a rotatable handle (33) secured to said shaft;

a bearing (21) connected between at least one wheel shaft (22) of each saddles at one common side of each saddle with said one wheel shaft extending beyond said bearing on both sides thereof; and a reduction gearing interconnecting said handle shaft and said one wheel shaft (22) at said one common side of each saddle;

said reduction gearing comprising an intermediate shaft (29) rotatably mounted through the one of said saddles adjacent said one side plate carrying said handle shaft and between said wheels mounted on said wheel bearing shaft (22, 26) of said one of said saddles, a pulley (31) on said intermediate shaft, a pulley (25) on one of said one wheel bearing shafts (22) of said one saddle, and a belt (32) connecting said pulleys for rotation, each of said one wheel shafts (22) of said one common side of each of said saddles connected to each other through pipes (23);

whereby the cabinet can be increased in frontage length by connecting an additional pair of connection members (9), an additional saddle (8) and an additional pipe (23) at one end of the cabinet;

pairs of said connection members at opposite ends of the cabinet having a length greater than pairs of said members intermediate the cabinet ends by one half the width of said saddles;

each fixture plate (11) of each saddle including at least two pairs of openings (10), each connection member (9) having at least one pair of openings (19) at each end thereof, each saddle other than said end saddles having each pair of openings thereof connected to one pair of openings from two adjacent pairs of connection members.

* * * * *